US005603207A

United States Patent [19]

Hartman

[11] Patent Number: 5,603,207

[45] Date of Patent: Feb. 18, 1997

[54] CRAFTS ROPE MAKER

[76] Inventor: Richard B. Hartman, 7516 201st Ave. SE., Issaquah, Wash. 98027

[21] Appl. No.: 597,142

[22] Filed: Feb. 6, 1996

[51] Int. Cl.[6] ..... D01H 9/02; D07B 3/02

[52] U.S. Cl. ..... 57/59; 57/25; 57/26; 57/60; 57/66

[58] Field of Search ..... 57/1 R, 59, 60, 57/64, 66, 314, 25, 26, 27

[56] References Cited

U.S. PATENT DOCUMENTS

| | | | |
|---|---|---|---|
| 31,615 | 3/1861 | Miller . | |
| 730,516 | 5/1902 | Culver | 57/26 |
| 775,125 | 1/1904 | Cline . | |
| 954,686 | 4/1910 | McIntosh . | |
| 967,174 | 8/1910 | Davis . | |
| 1,026,511 | 5/1912 | Jeschke . | |
| 1,275,103 | 8/1918 | Swanson | 57/25 |
| 1,370,742 | 3/1921 | Grant et al. | 57/25 |
| 1,430,519 | 9/1922 | Cattoor . | |
| 1,432,991 | 10/1922 | Fullington . | |
| 1,436,812 | 11/1922 | McMillian . | |
| 1,490,395 | 12/1924 | Maynard . | |
| 1,652,111 | 1/1927 | Fullington . | |
| 2,326,621 | 8/1943 | Corda | 57/25 |
| 2,578,618 | 12/1951 | Weinland | 57/25 |
| 2,935,838 | 5/1960 | Briscoe | 57/26 |
| 3,028,720 | 4/1962 | Houk | 57/25 |
| 3,208,036 | 9/1965 | Harrison | 57/25 |
| 3,704,578 | 12/1972 | Myers | 57/1 R |
| 4,065,080 | 12/1977 | Alison | 57/1 R |
| 5,517,813 | 5/1996 | Klundt | 57/25 |

FOREIGN PATENT DOCUMENTS

| | | | |
|---|---|---|---|
| 630786 | 12/1927 | France | 117/7 |
| 19139 | 2/1908 | Germany | 57/2 |
| 574894 | 3/1958 | Italy | 57/25 |

OTHER PUBLICATIONS

*Toy Book* pp. 115–117 1972 by Steven Caney Workman Publishing Co.

*Making Things* p. 89 1973 by Ann Wiseman Little Brown & Co.

"Braided Beauty Instructions" 1995 Mattel, Inc.

*Primary Examiner*—William Stryjewski

[57] ABSTRACT

Apparatus for making decorative crafts ropes including a hand-held motorized strand twisting unit and an improved method for rigging, anchoring and spreading strands. Strand twisting unit includes a frame or housing, hand grip, electrical circuit, motor, drive mechanism and twisting hooks. In the rigging process, twisting hooks are aligned and interspaced with a series of anchoring hooks on a strand anchoring unit so as to capture or snag two or more strand segments in a single motion.

9 Claims, 6 Drawing Sheets

CRAFTS ROPE MAKER

BACKGROUND—FIELD OF INVENTION

This invention relates to rope-making devices, specifically, an improved apparatus for creating decorative crafts ropes and cords.

BACKGROUND—DISCUSSION OF PRIOR ART

The process of making rope has been known since ancient times. Over the years, thousands of inventions improving upon the basic rope-making process have been disclosed. Few of these inventions, however, were developed primarily with the interests of children or adult crafts enthusiasts in mind. On the contrary, most examples of prior rope-making devices reveal heavy-duty equipment or machinery designed to meet the practical needs of workers in rural or industrial settings such as farms or factories. Inventions highlighting the educational or recreational value of rope-making are less common. A few prior art examples, however, do point to features in light-duty rope-making devices that are relevant to a discussion of the present invention.

The following discussion of prior art focuses on devices that include: 1) a hand-supported, or hand-held strand twisting unit employing a series of spinning hooks for simultaneously winding multiple strands; and/or 2) methods for rigging, anchoring and spreading the strands in a rope-making device.

U.S. Pat. No. 1,370,742 to Grant and Wertz (1921) discloses a hand-held strand twisting unit with a hand crank and rotating hooks for winding elastic bands on model airplanes. U.S. Pat. No. 1,430,519 to Cattoor (1922) discloses a hand-held strand twisting unit with a hand crank, rotating hooks, and a swiveling anchor hook. The crafts book, "Making Things—the Handbook of Creative Discovery" by Ann Wiseman (Little, Brown and Company, 1973, page 89) describes a home-made, hand-held rope winding machine made from wooden blocks and bent wire hangers.

As devices for creating decorative crafts ropes, these prior art examples suffer from a number of disadvantages, a prime disadvantage being that each requires the use of two hands during the strand twisting process—one hand to hold the body or handle of the twisting device, and the other hand to turn a crank. This requires a certain degree of coordination that could frustrate some children, and also prevents a person working by him- or herself from using a free hand to perform other helpful functions, such as smoothing the strands or checking for the tightness of wind while twisting is taking place. Grant and Wertz's device is additionally unsuitable as a recreational rope-making device since its hooks rotate in opposite directions, preventing two twisted strands from "laying" together as is typically required for making rope. Cattoor's invention has additional disadvantages including the requirement that an "attendant or assistant" continuously adjust a separate spreading device throughout the twisting process. Home-made rope-makers of the kind described by Wiseman easily jam and are therefore especially difficult for some children to operate successfully.

A hair braiding device manufactured by Mattel, Inc. solves at least one of the problems found in the hand-held strand twisting units described above. As shown in "Pocahontas, Braided Beauty Instructions" (Mattel, Inc., 1995) this invention permits the twisting of hair strands with just one hand through the use of a pump-action lever assembly that requires a repetitive pumping motion to turn a pair of detachable hair clips. While pointing in general to the advantage of hand-held strand twisting devices that can be operated with one hand, this invention suffers as a rope-making apparatus in particular, due to its lack of necessary twisting hooks and its lack of means for easily rigging, anchoring or spreading strands of yarn, ribbon or cord as would be required in a crafts rope maker. Also, while suitable for the twisting of short lengths of hair, a pump-action lever assembly would become tiring on a child's hand if adapted to twist significantly longer strands of cord as would be required, for example, in the making of a belt or a jump rope.

All of the above-cited prior art examples are, in fact, labor-intensive, and require a relatively large amount of work on the part of a child or adult in order to produce a modest amount of finished crafts rope. This limits the recreational appeal of such devices as crafts and hobby tools.

The particular method used for rigging and anchoring strands prior to twisting is an important factor in any rope-making apparatus intended for personal use. Spreading the individual sets of strands during the twisting process to prevent tangling is another challenge. Several prior art examples attempt to combine two or more of these functions—rigging, anchoring and spreading—with varying degrees of success. U.S. Pat. No. 1,275,103 to Swanson (1918) for example, discloses a hand-held anchoring and spreading tool with notches for receiving strands attached to a stationary twisting device. This method has several drawbacks: it requires substantial coordination of two hands (one for cranking and one for anchoring), it limits the lengths of rope one person can produce to his or her armspan, and it requires a complicated back-and-forth rigging procedure prior to twisting that could be confusing and frustrating for children to master.

U.S. Pat. No. 1,436,812 to McMillan (1922) discloses a "thread holder" with vertical thread-guiding prongs which both anchor and spread a series of strands. While solving the problems of anchoring and spreading, McMillan's invention fails to provide a simplified method of rigging or set-up. As in Swanson's disclosure, a child would be required to stretch a length of cord back and forth between a set of anchoring and twisting hooks numerous times before twisting could begin. This requires a certain degree of coordination, patience and consistency of strand tension that some children would have difficulty achieving, and poses additional problems if longer lengths of cord are used. For example, in McMillan's invention, both the twisting and anchoring devices need to be firmly mounted at a fixed interval for one person to rig an extremely long strand.

U.S. Pat. No. 2,578,618 to Weinland (1951) shows a table-mounted strand twisting device and a "holding plate" with multiple receiving hooks which needs to be supported by a second person during the rigging and twisting stages. While serving to adequately anchor and spread a series of strands, this solution requires that loops of consistent length be created from individual strands using hand-tied knots; this is a repetitive, time-consuming task that diminishes the invention's recreational appeal. Weinland's invention also has the obvious disadvantage of requiring two people to make longer lengths of rope.

In addition to the above-mentioned disadvantages, none of the prior art examples cited above anticipates a crafts rope maker in which a hand-supportable, or hand-held strand twisting unit is driven by a small electric motor, which eliminates the need for a hand crank or pump-action lever assembly, permits operation by one hand, greatly increases the speed and quality with which children and adults can produce crafts ropes, and thereby increases the level of interest and enthusiasm experienced by the user. In addition, none of the prior art examples anticipates a combined rigging, anchoring and spreading method in which the hooks on a hand-held strand twisting unit are aligned and interspaced with the hooks on a strand anchoring unit in such a way that a length of cord can be quickly and easily rigged, anchored and spread in a single step. Also, none of the prior art examples includes a set of tension clips that can be attached to the ends of a strand prior to rigging in order to facilitate a simplified rigging process and eliminate the need for hand-tying anchor knots. Finally, none of the prior art examples anticipate the use of a suction cup to temporarily mount a strand anchoring unit to a wall, window, appliance door or other smooth, non-porous surfaces—a feature especially appealing in a rope-making device intended for light-duty home and crafts use where yarns, ribbons and other light-weight materials are typically used.

Because modern, industrial rope-making machinery has made high-quality ropes and cords so widely available, the need for a personal rope-making device of the kind herein described has been largely overlooked. However, the process by which rope is made remains an intriguing phenomenon for many people, and a light-weight personal rope-making apparatus for use by children and adults is highly desirable as an entertaining and creative tool. Therefore, it can be seen there remains a need for a crafts rope maker incorporating a hand-supportable, or hand-held strand twisting unit driven by a small electric motor, and a simplified method for rigging, anchoring and spreading that can be performed by a wide range of ages, from children to adults.

OBJECTS AND ADVANTAGES

Accordingly, the objects and advantages of my invention are to provide:

(a) a crafts-rope maker including a hand-supported or hand-held strand twisting unit driven by an electric motor, which permits the twisting of strands of yarn, ribbon or cord with one hand, that can be safely used by children and adults to create decorative crafts ropes of varying lengths, thicknesses and color patterns; and that can produce a relatively large quantity of finished rope in a short amount of time;

(b) a simplified method for rigging, anchoring and spreading the strands of yarn, ribbon or cord in a crafts rope maker in which the hooks of a hand-supported, or hand-held strand twisting unit are aligned and interspaced with a series of anchoring hooks thereby allowing a strand of any length to be quickly and easily rigged in a single motion prior to twisting, and thereby eliminating the complicated back-and-forth rigging procedure required in previous inventions;

(c) a set of tension clips that can be easily attached to the ends of a strand in order to eliminate the need for hand-tying anchor knots;

(d) the use of a suction cup to quickly and easily mount a strand anchoring unit on a wall, window, appliance door or other smooth, non-porous surface thereby increasing the versatility and flexibility of a rope-maker especially intended for use in non-industrial settings; and (e) A system for creating crafts ropes that is an entertaining and enjoyable source of recreation for children and adults, which can be used in a variety of locations including home, school, and even in the passenger areas of automobiles and airplanes, which is simple to operate and relatively inexpensive to manufacture, and which can be used to create a wide variety of patterns, thicknesses and lengths in decorative crafts ropes for friendship bracelets, headbands, belts and other crafts items limited only by the user's imagination.

Further objects and advantages of my invention will become apparent from a consideration of the drawings and ensuing description of it.

REFERENCE NUMERALS IN DRAWINGS

| | |
|---|---|
| 20 strand twisting unit | 22 housing |
| 24 hand grip | 26 twisting hook |
| 28 switch | 29 drive mechanism |
| 30 gear | 32 gap |
| 33 electric circuit | 34 electric motor |
| 36 motor shaft | 38 electrical contact |
| 40 battery plate | 42 battery |
| 44 connecting wire | 46 gear shaft |
| 48 flange | 50 strand anchoring unit |
| 52 base plate | 54 anchoring hook |
| 56 mounting notch | 58 suction cup |
| 60 mounting knob | 62 tension clip |
| 64 slot | 66 strand |
| 68 strand segment | 70 hand |

DESCRIPTION—FIGS. 1, 2, 3, 4, 5, 6, 7, 8, 9, 10

Figure 1:
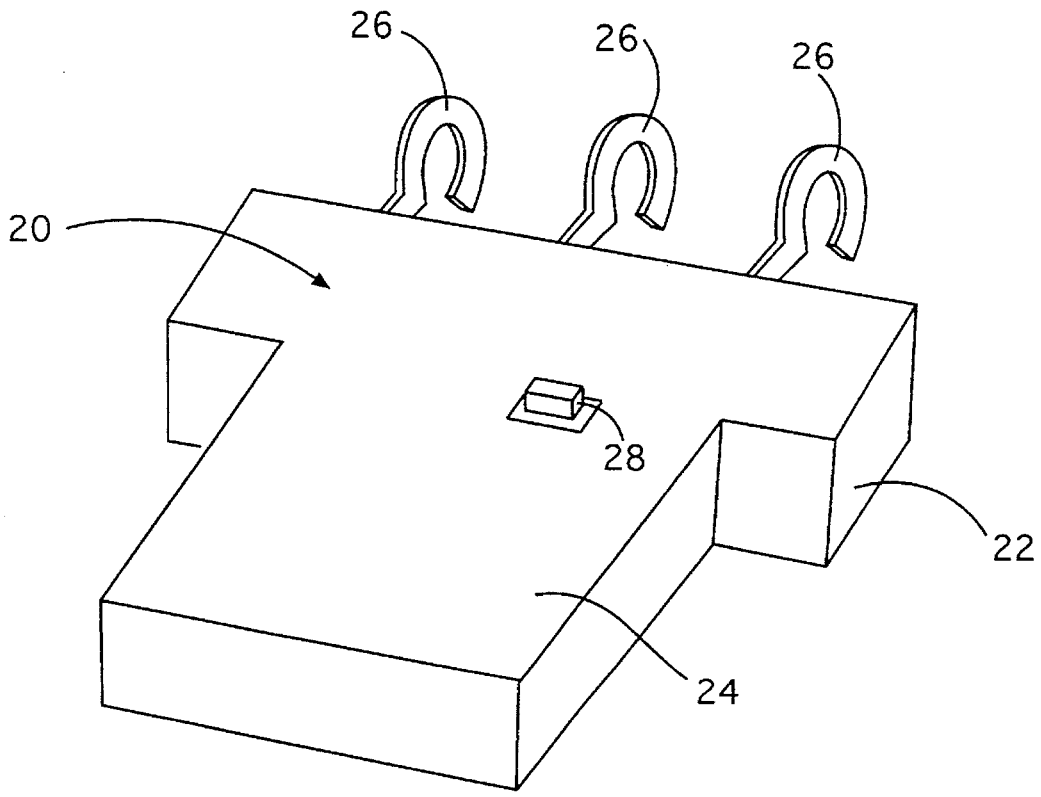
FIG. 1 is an perspective view of a hand-supported, or hand-held strand twisting unit in accordance with the present invention.
Figure 2:
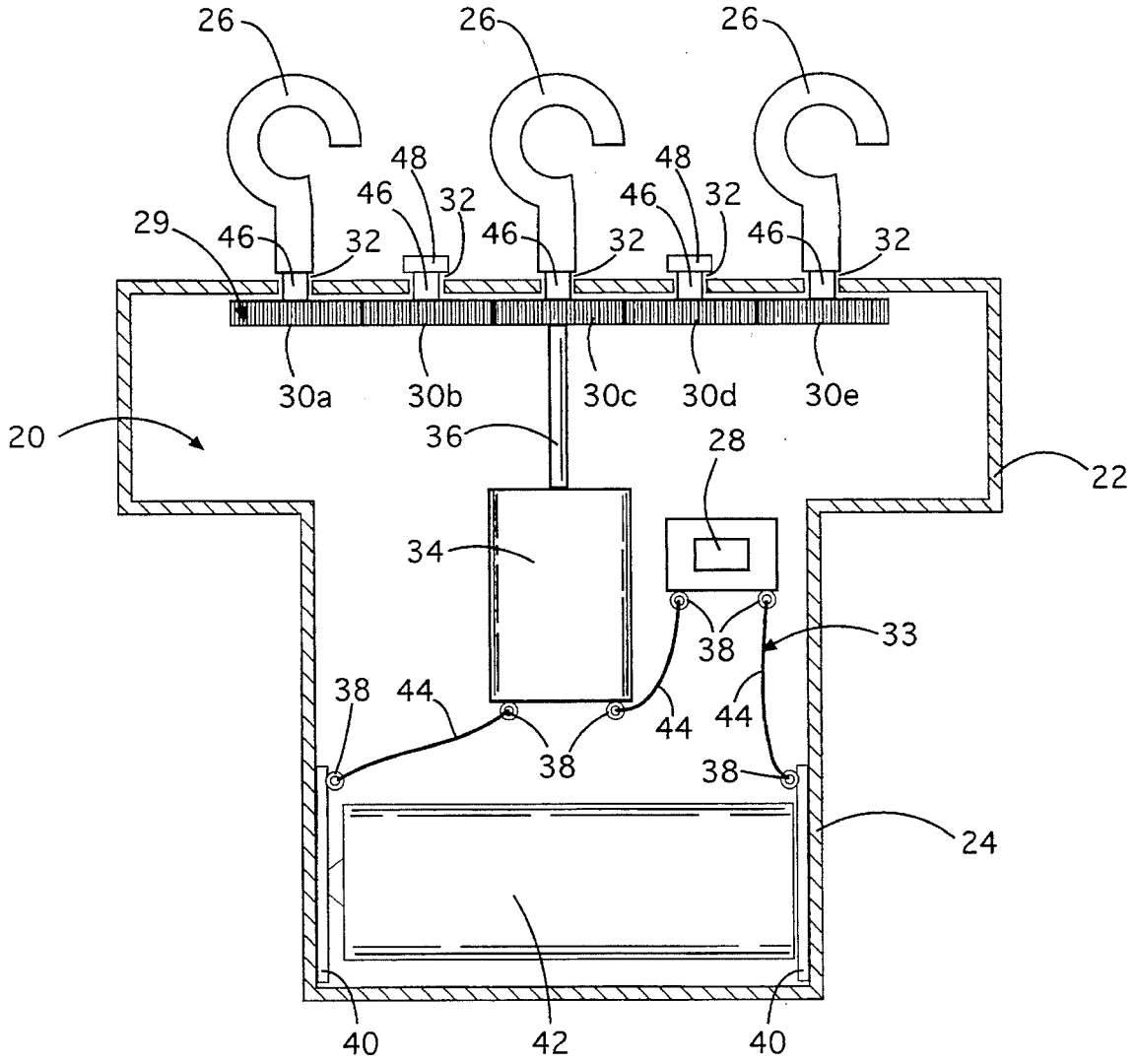
FIG. 2 is a top sectional view of the hand-held strand twisting unit shown in FIG. 1 with the top housing panel taken away.

A typical embodiment of the hand-held strand twisting unit of the present invention is illustrated in FIG. 1 (perspective), which shows external features, and FIG. 2 (top sectional), which shows internal components. The hand-held strand twisting unit 20 includes a frame or housing 22, a portion of which forms a hand grip 24. Three twisting hooks 26 and a switch 28 extend from housing 22. An electric circuit 33 and a drive mechanism 29 are contained within housing 22. Electric circuit 33 includes an electric motor 34, electrical contacts 38, switch 28, connecting wires 44, battery plates 40, and a battery 42. Drive mechanism 29 includes a motor shaft 36 and gears 30*a*, 30*b*, 30*c*, 30*d*, and 30*e* which are linearly arranged so as to engage one another in the manner shown. Motor shaft 36 extends from motor 34 and engages gear 30*c*. Gears 30*a*, 30*c*, and 30*e* are each connected to a twisting hook 26 via a gear shaft 46. Gears 30*b* and 30*d* each connect to gear shafts 46 which each terminate in a flange 48. Five holes or gaps 32 in housing 22 each receive and hold a gear shaft 46.

Figure 3:
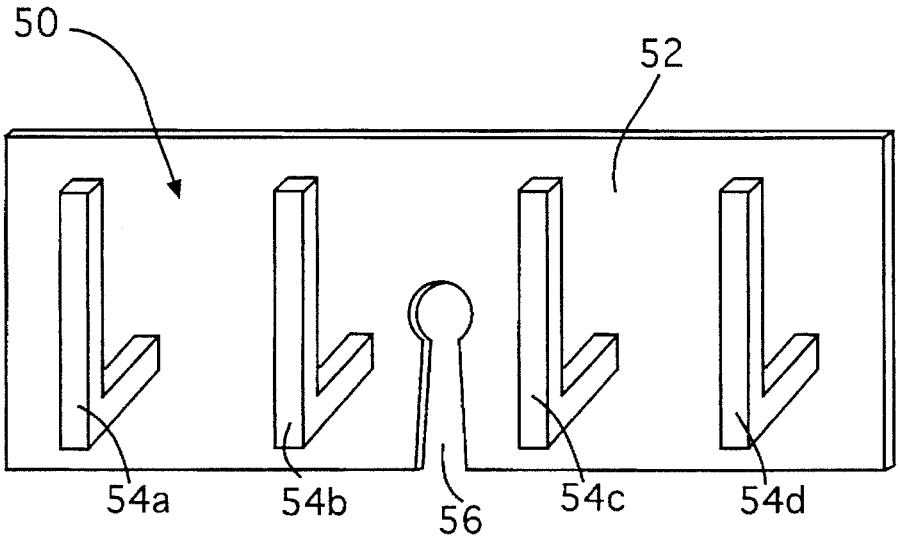
FIG. 3 is a perspective view of a strand anchoring unit in accordance with the present invention.

FIG. 3 is a perspective view of one particular embodiment of a strand anchoring unit in accordance with the present invention. Strand anchoring unit 50 includes a base plate 52, four anchoring hooks 54*a* though 54*d*, and a mounting notch 56.

Figure 4:
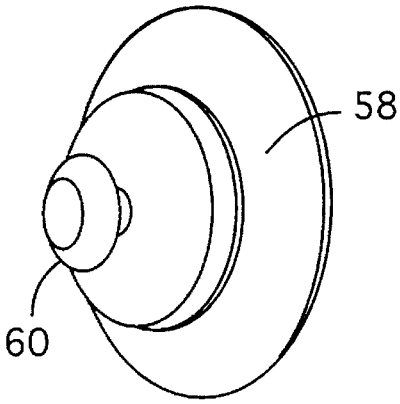
FIG. 4 is a perspective view of a commonly available type of suction cup which includes a mounting knob.

FIG. 4 is a perspective view of a commonly available type of suction cup 58 which includes a mounting knob 60.

Figure 5:
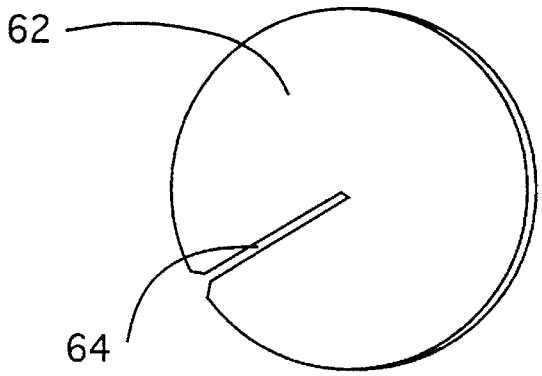
FIG. 5 is a perspective view of a tension clip of the present invention.

FIG. 5 is a perspective view of a tension clip 62 which includes a slot 64 in accordance with the present invention.

Figure 6:
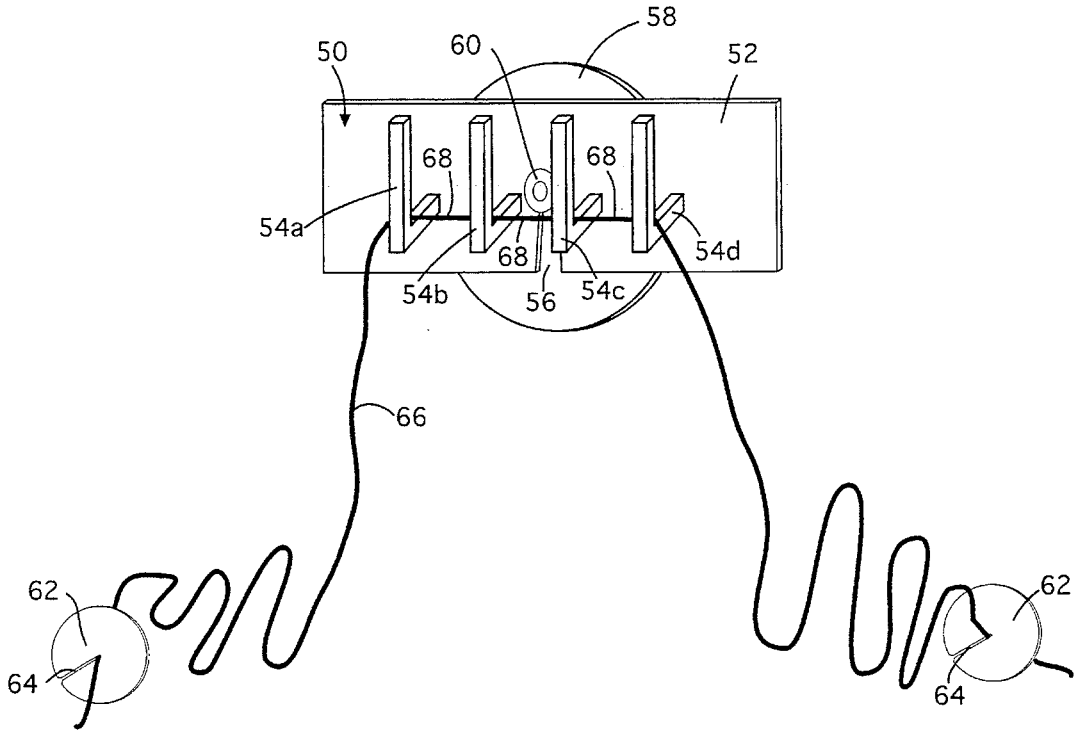
FIG. 6 is a perspective view that depicts how the strand anchoring unit, suction cup and tension clips illustrated in FIGS. 6, 7 and 8 can be assembled to receive a short strand, creating three strand segments prior to rigging.

FIG. 6 is a perspective view depicting the relative positions of a strand anchoring unit, a suction cup, and two tension clips when a short strand is first prepared for rigging. Strand anchoring unit 50 is mounted on suction cup 58 at mounting notch 56 and mounting knob 60. A strand 66 drapes or lies across strand anchoring hooks 54*a* through 54*d*, exposing three strand segments, 68. Near each end of strand 66, a tension clip 62 is attached by passing strand 66 through slots 64 in each tension clip.

Figure 7:
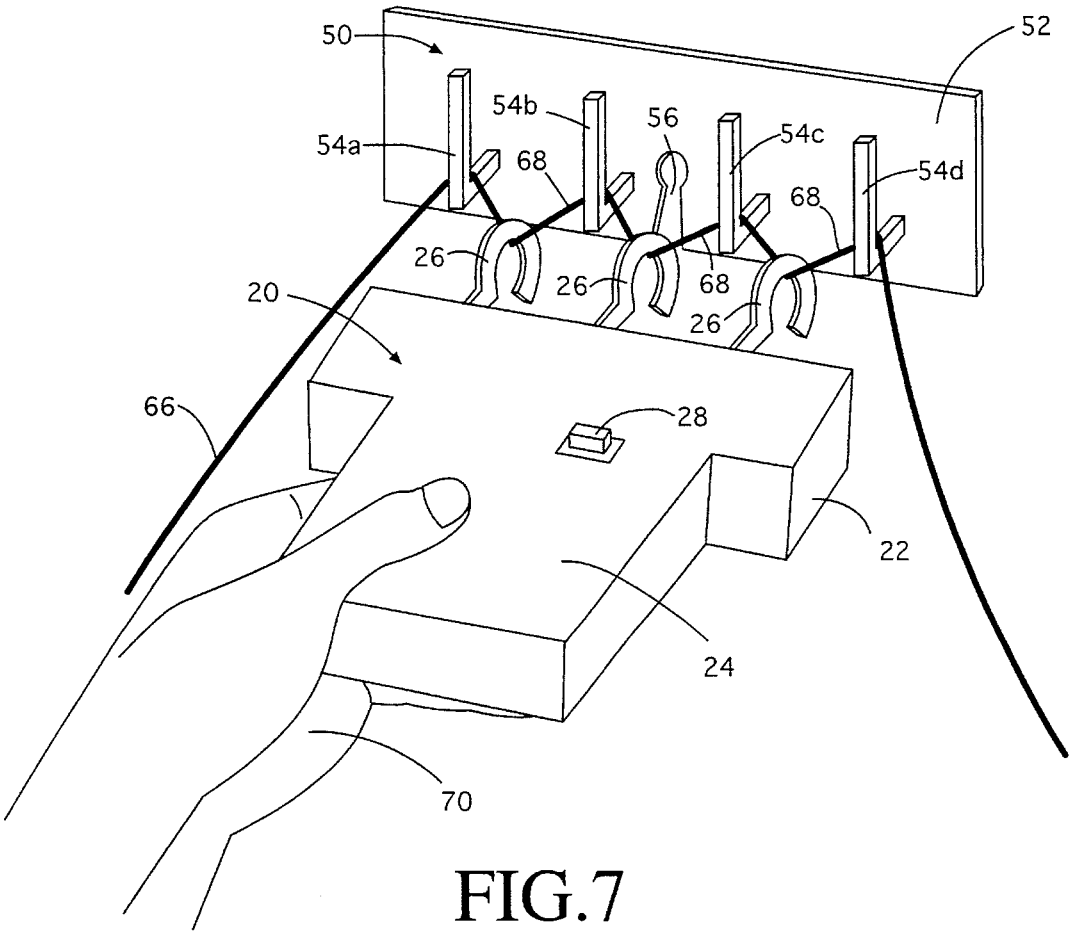
FIG. 7 is a perspective view that illustrates how the twisting hooks on a hand-held strand twisting unit can be aligned and interspaced with the anchoring hooks on a strand anchoring unit in order to simultaneously capture or snag a series of strand segments.

FIG. 7 is a perspective view that illustrates how the twisting hooks on a hand-held strand twisting unit can be aligned and interspaced with the anchoring hooks on a strand anchoring unit for quickly rigging or setting up a strand prior to twisting. In this procedure, twisting hooks 26 capture or snag strand 66 at strand segments 68.

Figure 8:
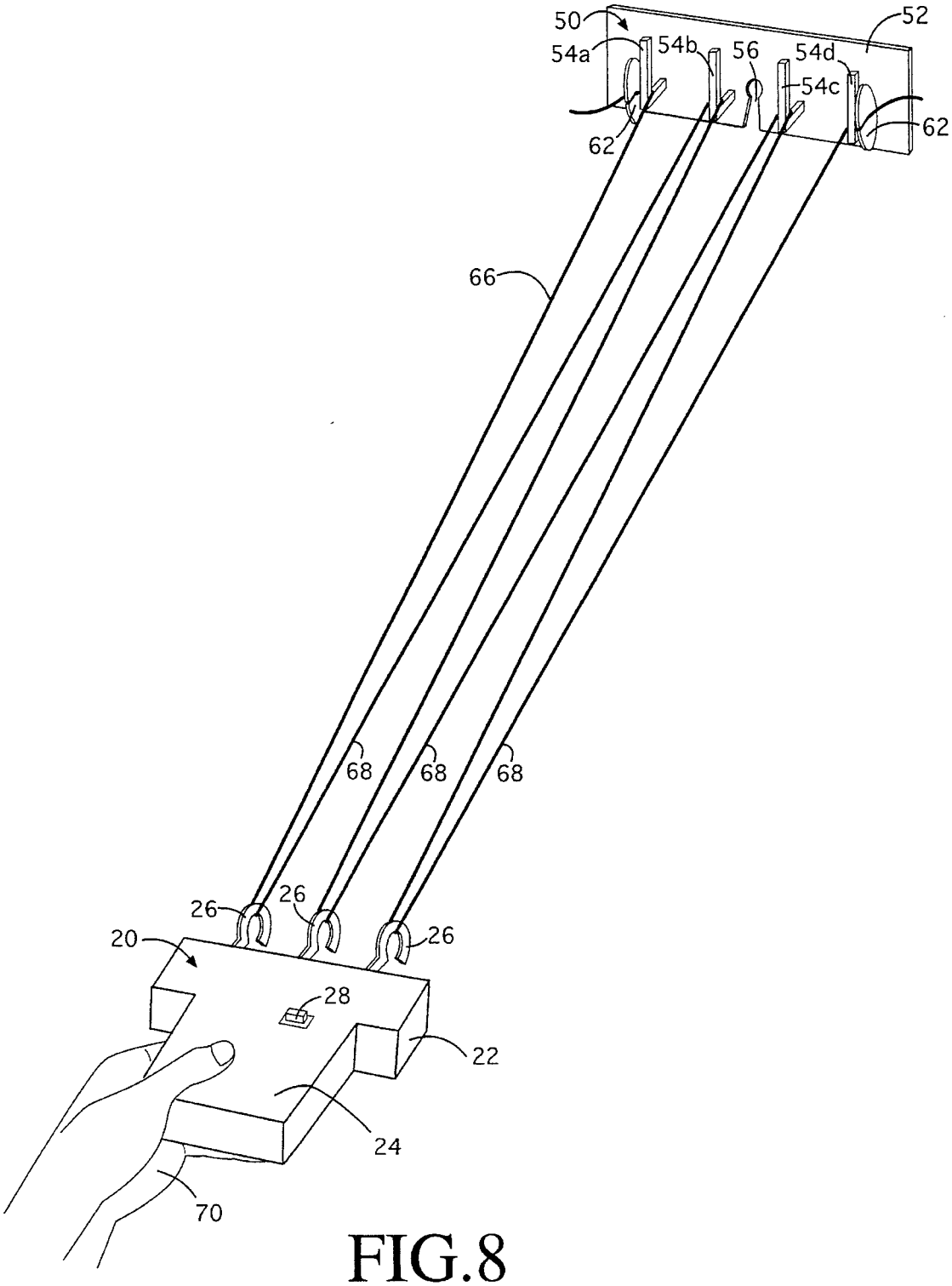
FIG. 8 is a perspective view showing the relative position of a hand-held strand twisting unit, a strand anchoring unit, two tension clips and a strand after the one-step rigging method of the present invention has been performed and just prior to twisting.

FIG. 8 is a perspective view that illustrates a fully, rigged strand ready for twisting in accordance with this invention. Strand twisting unit 20 has been pulled back or away from strand anchoring unit 50 so that strand 66 is fully, elongated and tension clips 62 are in contact with anchoring hooks 54*a* and 54*d*.

From the description above, a number of advantages of my crafts rope maker become evident:

(a) A hand-supported or hand-held strand twisting unit driven by an electric motor that imparts rotation on a series of twisting hooks provides an efficient and easy-to-use method for twisting strands of yarn and other light-weight filaments into decorative crafts ropes.

(b) A hand-held strand twisting unit driven by an electric motor eliminates the need for using two hands in the process of twisting strands for crafts ropes and eliminates the need for a tiring hand-crank mechanism or a slower pump-action lever assembly for imparting rotation on a series of twisting hooks.

(c) A hand-held, motorized strand twisting unit driven by an electric motor will have the unexpected result of encouraging creative experimentation as children and adults explore the varied patterns, textures and thicknesses of ropes that can be quickly and easily produced with different combinations of materials.

(d) A hand-held, motorized strand twisting unit of the kind described can be used safely by children and adults in a variety of non-industrial settings such as homes, classrooms or even in the passenger areas of automobiles and airplanes.

(e) A strand anchoring unit employing multiple anchoring hooks which can be aligned and interspaced with the twisting hooks on a hand-held strand twisting unit enhances the rope-making process by speeding and simplifying the rigging of strands prior to twisting.

(f) The use of tension clips eliminates the need for hand-tying anchor knots during rigging, further simplifying and speeding the process of making crafts ropes.

(g) Combining a commonly available suction cup with a strand anchoring unit has the unexpected result of encouraging and enabling the operation of a crafts rope maker in a wide range of indoor and outdoor settings.

(h) The materials used in my invention are common and readily available and my design is relatively simple, easy to assemble and inexpensive to produce.

OPERATION—FIGS. 1, 2, 3, 4, 5, 6, 7, 8, 9, 10

To operate the hand-supported, or hand-held strand twisting unit shown in FIGS. 1 and 2, a child or adult lifts the entire strand twisting unit 20 in one hand, supporting and holding it at hand grip 24. Housing 22 serves to stabilize and protect the internal components of strand twisting unit 20, including electric circuit 33 and drive mechanism 29. When the child or adult depresses switch 28 with his or her thumb or finger, electric circuit 33 is completed, allowing electricity from battery 42 to flow through battery, plates 40, electrical contacts 38, connecting wires 44 and electric motor 34. This causes electric motor 34 to begin turning which, in turn, actuates drive mechanism 29. Motor shaft 36 begins turning and imparts rotation on gear 30*c*, which in turn, causes gears 30*a*, 30*b*, 30*d*, and 30*e* to turn. In this embodiment, gears 30*a*, 30*c*, and 30*e* rotate simultaneously in one direction while gears 30*b* and 30*d* rotate in the opposite direction. Each gear 30*a* through 30*e* is connected to a gear shaft 46 which rests in and is stabilized by a hole or gap 32 in housing 22. Gears 30*a*, 30*c*, and 30*e* each terminate in a twisting hook 26, while gears 30*b* and 30*d* each terminate in a flange 48. When electric circuit 33 is interrupted by the release of switch 28, electric motor 34, drive mechanism 29 and twisting hooks 26 stop turning.

FIGS. 3, 4, 5 and 6 depict how a strand anchoring unit, a suction cup, two tension clips and a strand are arranged for easy rigging in accordance with one embodiment of the present invention. Mounting knob 60 on suction cup 58 is inserted into mounting notch 56 on strand anchoring unit 50 to form a firm connection. Suction cup 58 is then pressed against a smooth, non-porous surface such as a window, mirror or refrigerator door so that base plate 52 is temporarily but firmly mounted, and anchoring hooks 54*a* through 54*d* are pointing in an upward direction. The height and placement of suction cup 58 will depend on the height of the child or adult using the device and is an individual matter of preference. At each end of a strand 66, a tension clip 62 is attached. This is accomplished in the present embodiment by passing each end of strand 66 through slot 64 in tension clips 62 so that strand 66 is firmly engaged and held in place. Strand 66 is laid or draped across anchoring hooks 54*a* through 54*d*, exposing several strand segments 68.

FIGS. 7 and 8 depict the simplified method for rigging or setting up a strand prior to twisting in accordance with the present invention. Though described in detail, the entire rigging method is extremely easy to accomplish, creates consistent results, and can be performed in just a few seconds. Hand-held strand twisting unit 20 is lifted in the child or adult operator's hand 70 so as to bring it into close proximity with strand anchoring unit 50, which has been previously prepared with strand 66 as described above. Strand twisting unit 20 is positioned in such a way that each twisting hook 26 aligns with and captures or snags a strand segment 68 of strand 66. The operator then pulls strand twisting unit 20 back or away from strand anchoring unit 50. This causes strand segments 68 to gradually elongate as strand 66 is progressively drawn through strand anchoring unit 50 and tension clips 62 are pulled closer and closer toward anchoring hooks 54*a* and 54*d*. When tension clips 62 finally come into contact with anchoring hooks 54*a* and 54*d*, their further movement is impeded, tension is created on strand 66, and rigging is complete. The spacing between anchor hooks 54*a* through 54*d* serves to spread strand segments 68 apart so they will not tangle during twisting.

At this point, a child or adult need only depress switch 28 on hand-held strand twisting unit 20 to begin the twisting process. Strand segments 68 quickly wind about themselves. Since only one hand is required to perform this function, the operator can use his or her free hand to check on the tightness of the wind and the degree of tension in strand segments 68. When a desirable twist has been achieved, the child or adult can release switch 28, remove strand segments 68 from twisting hooks 26 and tie their ends together in a simple overhand knot. Alternately, an elastic band or other method can be used to bind the ends of the twisted strand segments together. All that remains is to release the strand segments and allow them to naturally twist around each other in a uniform pattern as is the tendency of strands twisted in the formation of rope. A small amount of smoothing or "stroking" to eliminate any kinks or imperfections in the finished rope may be useful at this point. After lifting strand 66 off strand anchoring device 50 and removing tension clips 62, the crafts rope is complete. A child or adult can then use his or her decorative rope to create head bands, friendship bracelets, belts, jump ropes and countless other crafts items.

To create thicker ropes, two or more strands can be draped or laid side-by-side in strand anchoring device 50, and held together at their ends by tension clips 62 prior to rigging. Multi-colored patterns can be created by tying several separate strands of different colors together end-to-end prior to rigging and twisting. Since no complicated mounting adjustments are required to accommodate strands of different lengths, any length strand can be rigged and twisted into rope, limited only by the amount of space available in a particular room.

SUMMARY, RAMIFICATIONS AND SCOPE

Accordingly, the reader will see that, when operated, my invention provides for a novel, versatile and previously unexploited kind of apparatus for creating crafts ropes and cords out of yarns, ribbons and other flexible strand materials. A hand-held strand twisting unit employing an electric motor to impart simultaneous rotation on a series of twisting hooks eliminates the need for a child or adult to use two hands during the twisting process, and dispenses with the need for a cumbersome hand-crank mechanism or a tiring pump-action lever assembly. A hand-held strand twisting unit of the kind disclosed also increases the rate at which a child or adult can produce and experiment with various colors, thicknesses and material combinations in creating crafts ropes, thereby increasing the learning potential and excitement level generated by such an apparatus. My invention also provides a simplified method of rigging, anchoring and spreading the strands in a crafts rope maker that further enhances the appeal of rope-making devices to children and adult crafts enthusiasts. Two main advantages result from my improved method of rigging, anchoring and spreading: First, the process is simple, quick and provides consistent results, and; second, extremely long strands can be easily rigged by one person without requiring the user to set down and secure the strand twisting unit before walking back and forth several times to perform the rigging. My invention also anticipates the use of a set of tension clips which eliminate the need for hand-tying one or more anchor knots during rigging, anchoring and spreading. The combination of a commonly available suction cup with a series of anchoring hooks also contributes to an extremely versatile strand anchoring unit especially appropriate in a crafts rope maker.

Lastly, my invention is relatively simple and inexpensive to produce, and appeals to a wide range of users, from very young children to adults.

Although the description above contains many specificities, these should not be construed as limiting the scope of the invention but as merely providing illustrations of some of the presently preferred embodiments of this invention. Many other variations are possible.

For example, the frame or housing on my hand-held strand twisting unit need not be limited to the T-shaped configuration disclosed in the accompanying drawings, but can be of any shape or size, as long as the strand twisting unit as a whole remains largely hand-supportable or hand-held. An endless variety of housing and hand grip shapes is possible. For example, they might be uniformly tubular, resembling the body of a common household flashlight. Alternately, a pistol-type hand grip and housing can be used. Even an unenclosed frame or housing can be used.

The drive mechanism of my hand-held strand twisting unit is not limited to the configuration shown in the current drawings. Any number, combination and/or arrangement of gears can be used in a drive mechanism to convey rotational motion upon a series of simultaneously twisting hooks. A combination of pulleys and belts can also be used in the drive mechanism of my invention. Any number of additional twisting hooks can be added to a hand-held motorized strand twisting unit and remain within the scope of my invention.

The electrical circuit of my invention is also not limited in scope to the exact configuration and components illustrated in the accompanying drawings. For example, while the switch illustrated in the accompanying drawings is of the common, push-on, release-off variety, any switching mechanism—including but not limited to slide switches, toggle switches and variable speed switches—can be used. The battery plates, electrical contacts and connecting wires shown can be replaced by metal contact strips or any other materials commonly used to fabricate electrical circuits. A wide range of motor and power supply configurations, styles and sizes is also anticipated.

The number of anchoring hooks on the strand anchoring unit of my invention can be varied, and these hooks can be substantially "C"-shaped or of any other shape or size that serves their intended function. Also, the tension clips of my invention can be varied in shape, style or size. For example, a two piece, spring-loaded "clamshell" clip can be employed as a tension clip in my invention. Also, the specific means for securing my strand anchoring device to a suction cup is not limited to the preferred method described; a common screw-type connection or other method can be used.

While I consider my simplified method for rigging a strand in a crafts rope maker to be novel and unobvious, my invention is not limited to embodiments of hand-held, motorized strand twisting units that specifically require the use of tension clips, a strand anchoring unit with multiple anchoring hooks, and/or a suction cup wall mount.

Accordingly, the scope of the invention should be determined not by the embodiment(s) illustrated, but by the appended claims and their legal equivalents.

I claim:

1. In an apparatus for making decorative crafts ropes, a hand-supported or hand-held strand twisting unit comprising:

(a) a frame or housing, said frame or housing including a handle or supporting means for supporting and stabilizing said strand twisting unit with one hand;

(b) a plurality of twisting hooks rotatably mounted on or within said frame, said twisting hooks providing capturing means for simultaneously capturing or snagging a strand at a plurality of predetermined strand segments or points along said strand with the same hand;

(c) rotating means for imparting a rotary motion upon said twisting hooks to twist the individual strand segments, said rotating means including controlling means for controlling said rotary motion with one hand while said hand-held strand twisting unit is held by the same hand.

2. The apparatus of claim 1, further including a strand anchoring unit comprising a plurality of anchoring hooks and mounting means for securely mounting said plurality of anchoring hooks during rigging, said anchoring hooks providing means for receiving a strand and delimiting a plurality of strand segments in said strand, wherein said strand segments are simultaneously captured or snagged by said twisting hooks of said hand-held strand twisting unit during rigging or set-up.

3. The strand anchoring unit of claim 2 further employing one or more tension clips, said tension clips providing engaging means for engaging a strand and anchoring means for anchoring said strand to said anchoring hooks.

4. The strand anchoring unit of claim 2 wherein said mounting means includes a suction cup and means for attaching said suction cup to said strand anchoring unit.

5. The hand-held strand twisting unit of claim 1 wherein said rotating means includes an electrically-driven motor and conveying means for conveying rotational force from said motor to said twisting hooks.

6. An apparatus for making decorative crafts ropes comprising:

(a) a strand anchoring unit including a plurality of anchoring hooks and mounting means for securely mounting said plurality of anchoring hooks during rigging, said anchoring hooks providing means for receiving a strand and delimiting strand segments in said strand;

(b) a hand-held strand twisting unit comprising a frame or housing, said frame or housing including a handle or supporting means for supporting said hand-held strand twisting unit with one hand; twisting hooks rotatably mounted on or within said frame or housing, said twisting hooks providing capturing means for simultaneously capturing or snagging said strand segments from said strand anchoring unit during rigging; rotating means for imparting rotary motion upon said twisting hooks to twist the individual strands.

7. The strand anchoring unit of claim 6 further including one or more tension clips, said tension clips providing engaging means for engaging a strand and anchoring means for anchoring said strand to said anchoring hooks.

8. The strand anchoring unit of claim 6 wherein said mounting means is a suction cup and means for attaching said suction cup to said strand anchoring unit.

9. The hand-held strand twisting unit of claim 6 wherein said rotating means includes an electrically-driven motor and conveying means for conveying rotational force from said motor to said plurality of twisting hooks.

* * * * *